United States Patent [19]

Barry et al.

[11] Patent Number: 4,724,007

[45] Date of Patent: Feb. 9, 1988

[54] METHOD OF CLEANING PIPES AND TUBES BY PIGGING USING WATER HAMMER SHOCK WAVES

[75] Inventors: Peter L. Barry, Narre Warren; Robert W. Vowles, North Melbourne, both of Australia

[73] Assignee: Lacress Nominees Pty. Ltd., Camberwell, Australia

[21] Appl. No.: 858,859

[22] Filed: Apr. 30, 1986

[30] Foreign Application Priority Data

Aug. 17, 1984 [AU] Australia ..... PCT/AU84/00 159

Related U.S. Application Data

[63] Continuation of Ser. No. 648,882, Sep. 10, 1984, abandoned, which is a continuation-in-part of Ser. No. 527,269, Aug. 29, 1983, abandoned.

[51] Int. Cl.[4] ..... B08B 9/04

[52] U.S. Cl. ..... 134/1; 134/8; 15/3.5; 15/104.062

[58] Field of Search ..... 15/3.5, 3.51, 104.05, 15/104.06 R, 104.06 A, 104.07; 134/1, 8, 22.11, 22.12, 24, 166 R, 184

[56] References Cited

U.S. PATENT DOCUMENTS

| | | | |
|---|---|---|---|
| 1,034,301 | 7/1912 | Redeker | 134/8 |
| 1,806,270 | 5/1931 | Thompson | 15/3.5 |
| 2,874,078 | 2/1959 | Reinhart | 134/8 |
| 3,148,689 | 9/1964 | Bean et al. | 15/104.06 A X |
| 3,409,470 | 11/1968 | Karpovich | 134/22.12 X |
| 3,451,091 | 6/1969 | Wallace | 15/3.5 |
| 3,531,813 | 10/1970 | Hurst | 15/104.06 A X |
| 3,562,014 | 2/1971 | Childers et al. | 15/104.06 A X |
| 3,631,555 | 1/1972 | Hurst et al. | 15/104.06 A X |
| 4,003,393 | 1/1977 | Jaggard et al. | 15/104.06 R X |
| 4,252,255 | 2/1981 | Henderson | 15/3.5 |
| 4,353,414 | 10/1982 | Leitner | 15/104.06 A X |
| 4,467,488 | 8/1984 | Creek | 15/3.5 |

*Primary Examiner*—Richard V. Fisher
*Assistant Examiner*—W. Gary Jones
*Attorney, Agent, or Firm*—Robert F. O'Connell

[57] ABSTRACT

Pipes or tubes, for example, in heat exchangers, can be cleaned internally using a water hammer shock wave with a relatively incompressible pig which travels at high velocity and a flushing liquid. FIG. 1 illustrates the use of launcher (14) to apply a very rapid pressure build-up by means of a liquid to one end of a pig located in a tube (11) to be cleaned.

13 Claims, 20 Drawing Figures

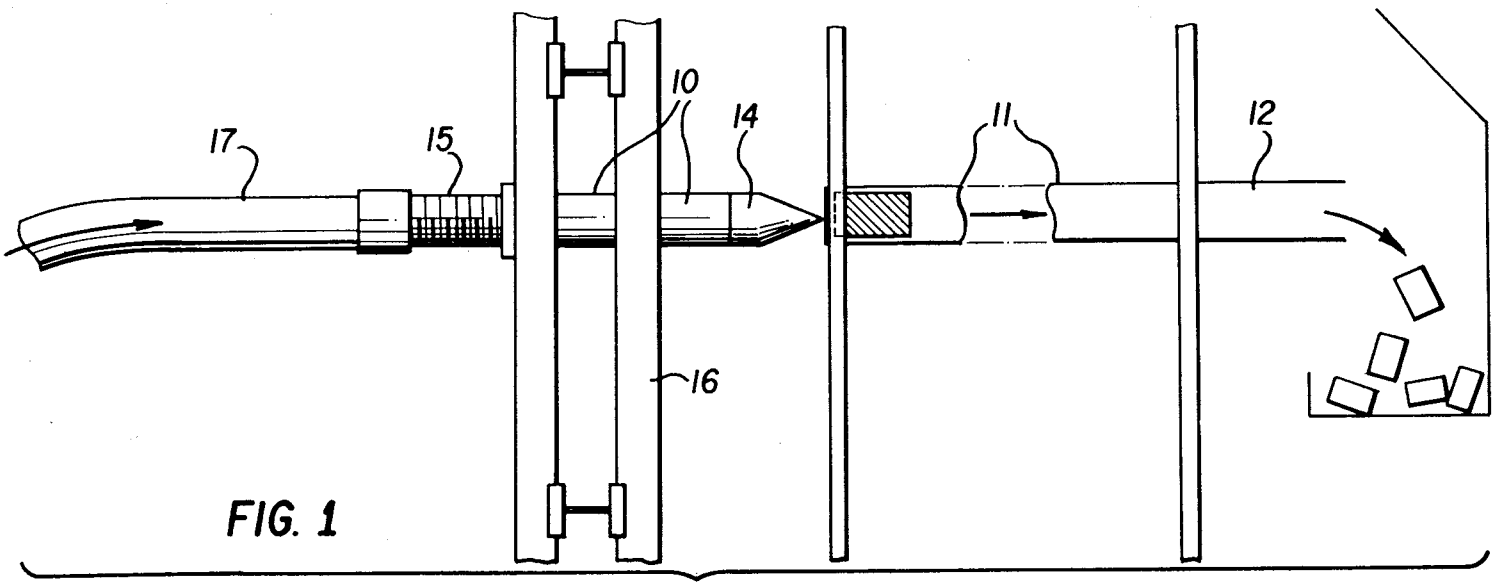
FIG. 1
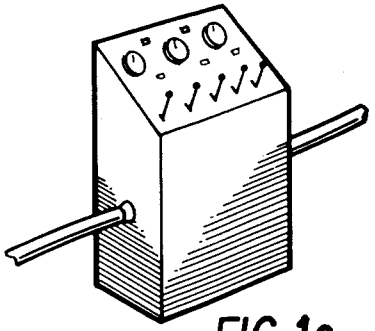
FIG. 1e
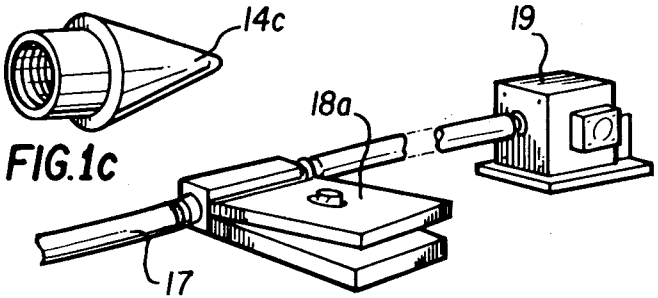
FIG. 1d
FIG. 1c
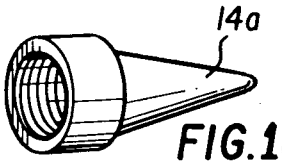
FIG. 1a
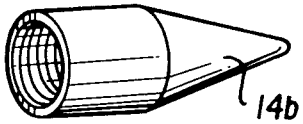
FIG. 1b

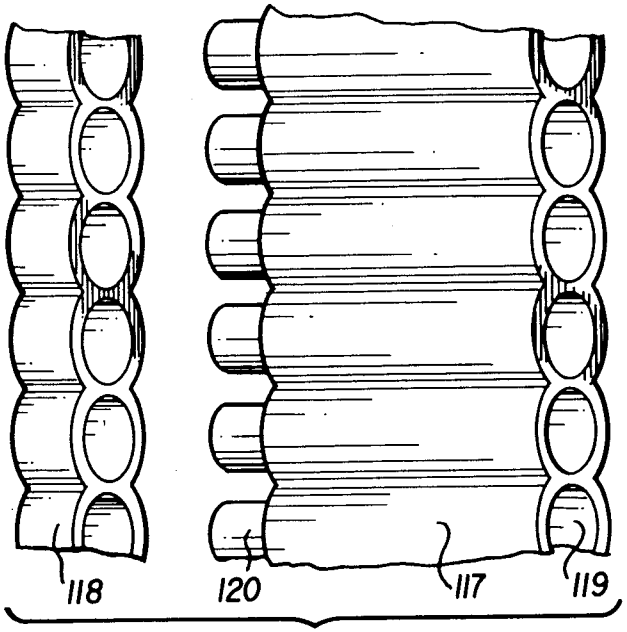
FIG. 14
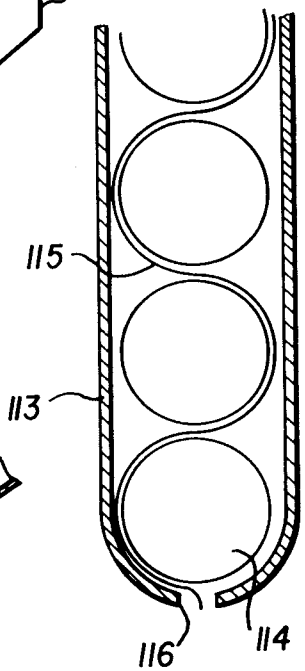
FIG. 13
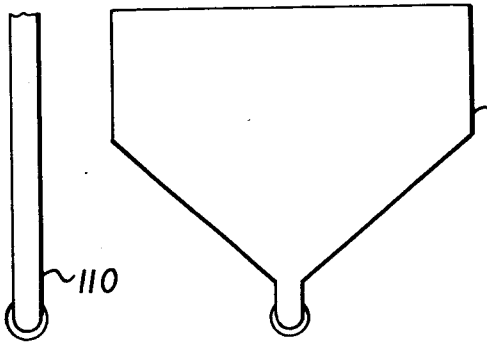
FIG. 11
FIG. 10
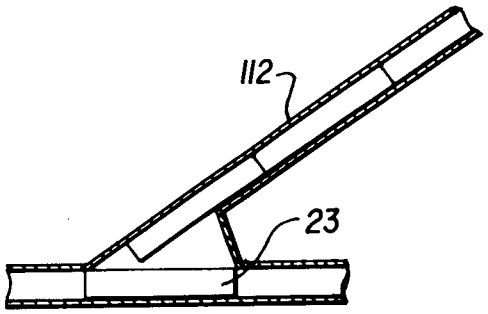
FIG. 12

METHOD OF CLEANING PIPES AND TUBES BY PIGGING USING WATER HAMMER SHOCK WAVES

This is a continuation of co-pending application Ser. No. 648,882 filed on Sept. 10, 1984, which was a continuation-in-part of Ser. No. 527,269, filed on Aug. 29, 1983 (both abandoned).

FIELD OF THE INVENTION

This invention relates to a method of cleaning pipes, tubes etc. and apparatus suitable for use in such a method.

BACKGROUND OF THE INVENTION

In the chemical and oil industry one of the most persistent problems relates to the cleaning of the various connecting pipes and tubes, for example, the tubes in cooling systems, heat-recovery exchangers and condensers. (The word "tube" or "tubes" will be used hereinafter, as appropriate.)

The process may be exemplified by the production of styrene monomer. Various types of polymers and copolymers are deposited in the heat-recovery exchangers and in the condensers. The fouling caused by the deposit of such polymers decreases the overall efficiency of the systems involved. It is, therefore, necessary to clean the systems internally. One method of cleaning which has been used involves the use of high pressure water. This method is inefficient and in many cases cannot remove completely the build-up of solids on the walls of the tubes. Thus with one conventional cleaning head long gouges are cut in the solids on the walls. Furthermore, the method is very time consuming and expensive. It is also dangerous to use because of the very high pressure water streams involved and is becoming more dangerous as the pressures used increase.

Another method involves drilling out the tube. Again, this method is very time consuming and expensive. Furthermore, the drill can often become embedded in the material to be drilled. Again, when very hard polymers are encountered, the drill bit may be deflected and drill through the tube wall. If this occurs, the tube has to be either removed or plugged in place thus decreasing the efficiency of the exchanger. Even if these problems are not encountered, drilling does not completely remove material deposited on the tube walls. Generally speaking any mechanical cutting, drilling, gouging etc. method tends to score the surface of the tube leaving a region in or on which deposits can build up. The tube is damaged and weakened and its useful life shortened.

Other methods include cleaning using chemical solvents. However, this method can only be used if there is a flow pathway remaining. In addition there is a trend away from chemical cleaning methods because of the disposal problem in relation to the used solvent.

Yet another method is to burn out a deposit. However, it may be necessary to remove a particular piece of apparatus from the site so that this procedure can be carried out.

Typically, it is necessary to use a combination of methods, such as a combination of the water blast and drilling methods. Even so, such a combination may succeed only in obtaining an increase in efficiency of the cleaned apparatus of up to 90%.

It is known in the art of extracting and distributing petroleum to pass a "pig" of solid material through a pipeline to wipe deposited paraffins from the wall. Furthermore, "pigging" is a known technique in the cleaning of tubes. However the pigs used are flexible and compressible and are often provided with abrasives embedded in their outer walls or with cutting or gouging devices projecting through their outer surface. Such a pig is forced through a tube by hydraulic action mechanically gouging material from the wall of the tube and pushing debris in front of it. The problem here is that the surface of the tube can also be scored, gouged and weakened.

Generally speaking, prior art methods of pigging have involved:

mechanical brushing, scraping or abrading by pigs specially designed for that purpose; and/or low velocity passage through a tube, pushing the undesired material in front of the pig.

It is an object of the present invention to overcome the problems outlined above, that is, to provide a simple, relatively inexpensive, less dangerous and more efficient method of cleaning tubes.

SUMMARY OF THE INVENTION

This invention is based upon the observation that, when a hydrostatic pressure was applied over a very short time interval to a relatively incompressible pig positioned adjacent the outlet of such a tube, the pig could be passed at high velocity through said tube. A cleaning, even polishing, effect was obtained on the wall of the tube. The insides of the tubes were cleaned to a very considerable degree, in some cases over 95% and up to 99% of deposits were removed, including even rust and mill scale and, in other cases, bright metal was obtained.

It was believed initially that, where polymeric or copolymeric deposits are involved, an initial sonic wave and kinetic energy transmitted subsequently tends to degrade the polymeric structure and perhaps also break down any bonding between this structure and the metallic surface; see "Styrene—Its Polymers, Copolymers and Derivatives" eds. Ray H. Boundy and Raymond F. Boyer, Reinhold, N.Y. 1952.

It is now thought that the initial breakdown is not necessarily due to "sonic" energy and that what might have been sonic energy is more likely to be some mechanical effect akin to the effect produced in water hammer. Furthermore, at the temperatures and over the time scales used, the polymer breakdown discussed by Boundy and Boyer is unlikely to occur.

Accordingly, this invention provides a method of cleaning tubes by pigging which comprises:

(1) applying a very rapid pressure build-up by means of a liquid to one end of a suitably dimensioned, relatively incompressible pig located adjacent one end of said tube locus; and (2) maintaining pressure on said pig for a sufficient time to force said pig at high velocity through said tube locus to be cleaned, whereby said deposits are loosened within said tube and expelled from said tube.

A launcher is connected to a source of water or other cleaning liquid, pressurised to a suitable pressure by a multi-cylinder, positive-displacement pump, the output pressure of which is characterised by a continuous series of pressure pulses. The liquid under pressure is restrained by a valve adapted to allow the release of said liquid over a very short time interval. The connector between the pressure pump and the launcher is constructed in a way to minimized the absorption of the pump-generated pressure pulses. A pig is located in a tube to be cleaned, adjacent the end of deposits to be removed.

When the said valve is opened, the pressurized cleaning liquid is released in such a manner that there is a very rapid pressure build-up upon the rear face of the pig. The pig is driven through the tube at a high velocity. It is thought that, where a tube is fouled with a heavy deposit of contaminant material, the pig is brought violently into contact with this material and may be momentarily arrested. This momentary arrest of the pig may produce a water hammer effect in the column of cleaning liquid following the pig, and the resultant shock passes down the length of the tube as a pressure wave or waves. However, other water hammer effects may also occur, for example, upon the opening of the valve.

In some forms of contaminant material, such water hammer-generated shock or pressure wave may disrupt the bond between the material and the wall of the tube and may cause the material to revert to a particulate or granular form. This seems to occur in tubes which are completely filled with contaminant material and which, hitherto, could only be cleaned by drilling.

The tube behind the pig is pressurized with cleaning liquid which continues to propel the pig rapidly through the tube, pushing the disrupted contaminant material ahead of it, the pump-generated pressure pulses reinforcing the flow. The pig and material are subsequently ejected from the outer end of the tube into a suitable catching means.

Where a heavy deposit of contaminant material is more tenacious, cleaning is effected by several passes of pigs of increasing diameter. The diameter of the pig first passed is selected to permit it to penetrate the lumen of the contaminated tube, and the pig is launched through the tube in the manner described above. If a pig of correct diameter is selected by the operator, it is accompanied during its penetration of the contaminant material by a flow of pressurised cleaning liquid which fills the annular space between the pig and the contaminant material. This flow of minimized cleaning medium passes the pig, the progress of which is retarded by the contaminant material. It is thought that the flow of minimized cleaning medium emerges on the downstream side of the pig as an energetic annular jet, which erodes the contaminant material ahead of the pig, allowing it to progress through the tube. This process is then repeated with a pig of larger diameter.

Where a tube is contaminated with a light coating only of material in a laminar form, or where a heavy deposit has been reduced to this form by multiple passes of pigs, final cleaning is effected by passing a pig with a small clearance between it and the tube.

Where a pig is launched through a relatively clean tube, it passes through the tube at high velocity at the leading edge of the flow of cleaning medium. In these circumstances, it might be that little if any annular flow occurs past the pig. The effect of the high-velocity passage of the pig is to remove substantially all material from the internal surface of the tube, with a very high degree of efficiency. This effect is not fully understood, but may be the result of cavitation in the wake of the pig produced by a toroidal vortex generated at the rear of the pig by the viscous attachment of the cleaning liquid to the tube wall.

In all cases, the pig emerges from the tube apparently undamaged. It seems, therefore, that the cleaning effects produced and described above are not the result of mechanical scraping by the pig.

As discussed above, desirably the pig is dimensioned to:

travel in said tube propelled by said liquid; and provide a high velocity, annular jet of liquid ejected forwardly of said pig relative to its direction of travel in said tube.

The annular jet serves the dual purpose of lubricating the travel of the pig and breaking up the deposits. The pig can be shaped to promote the formation of these jets, for example, its trailing end may be slightly chamfered.

The pig may be made of any suitable relatively incompressible material such as a suitable metal, ceramic material, composite material or plastics material, in particular a stiff, strong plastics material of the type used to replace die cast parts in gears, bearings and housings and which has good resistance to solvents. A suitable plastics material has been found to be "Delrin". This material is dimensionally stable under the conditions of use.

A pig of ice may also be used, for example, where a tube has been distorted during dismantling of a tube bundle or removal to a cleaning pad. An ice pig may jam in an oval tube without serious consequences arising.

It is possible to machine such a pig to fit closely the particular dimensions of a tube to be cleaned. This feature is subject, of course, to a limitation in that the pig may not move at all, if there is too small a clearance. For example, clearances of between 0.01" and 0.005", desirably 0.0085", have been found suitable with a Delrin pig used to clean a steel tube.

In known pigging techniques rather complex pigs have been used, having abrasive material incorporated therein as described above. One advantage of the present method is that a simple pig may be used, for example, a simple cylinder of plastics material or a ball (where U-tubes are to be cleaned).

For preference the liquid used is water but other relatively inexpensive liquids could be used.

Suitably the pressures used are in the range from 1,000 to 10,000 psi, preferably from 1,000 to 6,000 psi. The pressure used will depend on the particular application, for example, so-called fin-fan tubes are of relatively thin wall thickness but boiler tubes are of relatively heavier wall thickness. Furthermore, larger diameter tubes (all other things being equal) have lower burst strengths than smaller diameter tubes.

Said liquid may be applied at high pressure by means of a snap-on valve connected in line with a high pressure pump.

The very rapid pressure build-up is produced by, for example, placing a suitable launcher adjacent the inlet of a tube into which a pig has been inserted. For preference, the launcher is so positioned that a not quite perfect seal is obtained between the launcher tip and the tube inlet. A powerful water pump is attached to the launcher and the water pressure applied to the pig by way of, for example, a foot operated valve such as an air-operated instant release valve. The internal diameter of the launcher should be selected to prevent or minimise pressure drop in this region. Desirably, the connector supplying the liquid to the launcher is of greater internal diameter than that of the launcher.

A suitable pump is, for example, a triplex high pressure pump which delivers up to 6,000 strokes per minute. It may be that, with each stroke, a pressure wave is transmitted through the incompressible column of water, the kinetic energy of the pistons being transmitted to the pig and to the deposits. These waves may contritube to further breaking down of the internal structure of the deposits and their mode of attachment to the tubes.

As mentioned above, the seal between the launcher and the end of the tube to be cleaned is preferably slightly imperfect or may be provided with a calibrated leak. This allows a pressure drop to occur in those cases where it is necessary to repeat the rapid pressure build-up upon the pig, where deposits are more resistant to removal.

The method according to the invention may be used to clean a bank of tubes, for example, in a heat-exchanger, wherein pigs are inserted in the ends of said tubes and said rapid pressure build-up is applied:

sequentially to each tube; or simultaneously to a selected number of said tubes.

This embodiment of the invention allows greater efficiency in the cleaning of large numbers of tubes. For example, the pump may be connected to a pressure manifold to which a number of pressure outlets are connected. These outlets are each provided with suitable valve means leading to a launcher. The apparatus may be mounted on a suitable frame to allow movement vertically and horizontally so that one or more tubes in said bank may be cleaned sequentially. However, generally speaking this manifold embodiment cannot be used to launch a number of pigs simultaneously, since the pressure drop on opening a number of valves simultaneously would be unacceptable. Much will depend on the output of the pump used.

This invention also provides a launcher for use in the method according to the invention. At the other end of the tube a so-called catcher can be attached, leading into a cage to hold used pigs. The function of the launcher is to apply the hydrostatic pressure to the trailing end of the pig.

Thus, this invention provides a launcher for use in a method according to the invention which comprises a high pressure connecting means and a launcher tip, wherein said launcher tip is adapted to engage the end of a tube to be cleaned and is of such internal diameter that pressure drop within said launcher tip is prevented or minimised whereby liquid is brought into contact with a pig but minor leakage is permitted between said launcher tip and said tube end.

This invention also provides an apparatus for use in a method according to the invention which comprises in combination a source of high pressure liquid, quick-operating valve means and one or more launchers as defined above.

The apparatus according to the invention may also comprise in addition a magazine for pigs associated with each launcher whereby such pigs may be fed sequentially to said launcher.

In another preferred embodiment, a partial sealing element is included which is adapted to provide a partial seal between said launcher tip and said end of a tube to be cleaned. Again, a safety interlock means may be included whereby a pig may not be launched when said safety means is operative.

Location and support means are also provided for use in a method according to the invention which means comprises an X-Y frame adapted to maintain one or more launchers according to the invention in position with respect to the end or ends of a selected tube or tubes to be cleaned whereby said tube or tubes may be cleaned sequentially or simultaneously. Preferably, said X-Y frame comprises vertical support beams and horizontal support beams in combination with movable support means for one or more launchers, which movable support means is adapted to maintain said launcher or launchers in position and to resist back pressure when said launcher or launchers are used according to the invention.

An alternative embodiment of said location and support means comprises a rotary axis adaptor adapted to maintain one or more launchers according to the invention in position with respect to the end or ends of a selected tube or tubes to be cleaned whereby said tube or tubes may be cleaned sequentially or simultaneously.

Preferably, said rotary axis adaptor comprises a radial support beam or beams in combination with an axial support means and radially-movable support means, which axial support means is adapted for attachment to a bundle of tubes to be cleaned and which radially-movable support means is adapted to maintain said launcher or launchers in position and to resist back pressure when said launcher or launchers are used according to the invention.

The X-Y frame and the rotary axis adaptor described above may be regarded as primary location and support means. It may be desirable in some applications to provide secondary location and support means to advance the launcher tip to the end of the tube to be cleaned, maintain said launcher in position and withdraw it, as required.

This invention will now be explained by reference to specific applications.

APPLICATION 1

FIN FAN EXCHANGERS

The high efficiency of fin fan exchangers, in certain applications, has increased their popularity and utilization. However their size and location make the exchangers extremely difficult to clean.

Due to the common header design, most fin fan exchangers are chemically cleaned whenever possible. In many cases, however, there is complete blockage of tubes and a water blaster or an air drill must be used. Both of these methods are severely hampered by the length and location of most fin fan exchangers. Although these methods are only marginally effective, they are expensive in terms of time and money.

The process according to the invention can be used for fin fan exchanger cleaning because a smaller working space is necessary. In addition it is more efficient than prior art methods.

In one example a drilling method was used in an attempt to clean a bank of fin fan exchangers. An acceptable standard of 75% operating capacity was achieved, that is, 25% of the tubes remained blocked. Using the method according to the invention approximately 99% efficiency was obtained. Furthermore, the overall shut-down period was reduced considerably.

APPLICATION 2

U-TUBE HEAT EXCHANGERS

Although U-tube heat exchangers have advantages in efficiency they are often the most troublesome of all exchangers due to fouling. Fouling is a severe problem because the U-portion of the exchanger is so difficult to clean.

If there is a possibility that any of the tubes in the bundle are completely plugged, chemical cleaning is not an option. Water blasting is usually the most effective way to clean a U-tube exchanger. This process works fairly well on some broad radius bends, but not on narrow radius bends. At best a narrow radius bend can be partially cleaned only by this process.

Cleaning according to the invention is the only effective way to thoroughly clean a plugged U-tube exchanger. it will completely remove the entire deposit from each tube regardless of the radius of the bend or the consistency of the deposit.

APPLICATION 3

STRAIGHT TUBE HEAT EXCHANGERS

The most common of all heat exchangers is the straight tube and shell exchanger. Regardless of what substance moves through the exchanger tubes, some degree of fouling will eventually occur. The fouling will vary from soft deposits to complete solid plugging.

The method of cleaning used on straight tube exchangers varies according to the type and consistency of the deposit. Slightly fouled tubes can generally be cleaned by water blasting or chemical cleaning. Hard, solid tube plugging is usually cleaned by water blasting, drilling or removing the exchanger and burning out the deposit. While all of these methods work, they work with varying success, and they all can be prohibitively expensive.

Cleaning according to the invention will remove substantially all deposits, whether hard or soft. The precise technique used will vary according to the application, for example, it may be necessary to use a series of pigs of increasing size.

APPLICATION 4

DOUBLE PIPE EXCHANGERS

Double pipe heat exchangers are the simplest of all heat exchanger designs. Instead of becoming completely fouled, this exchanger frequently develops a thin laminar deposit that prevents effective heat transfer.

Chemical cleaning is usually ruled out since most of the deposits cannot be readily dissolved. There is also a possibility that a trace of residue from the cleaning solution could contaminate a future product stream. In addition, the hardness of the deposit often precludes water blasting. If the exchanger is a continuous U-tube design, a water blast hose cannot make the turns and cannot be used. Often, this U-tube type exchanger must be removed from the plant and sent to an exchanger repair company to be burned out.

The process according to the invention can be used to deal with even the hardest laminar deposits. It has been used to clean continuous U-tube double pipe exchangers without removing the unit, thus saving considerable time and money.

BRIEF DESCRIPTION OF THE DRAWINGS

FIG. 1 shows in cross-section an embodiment of the invention as applied to a heat exchanger tube;

FIGS. 1*a*, 1*b* and 1*c* are perspective views from one side of three embodiments of launcher tip according to the invention;

FIGS. 1*d* and 1*e* are perspective views of suitable valve means used according to the invention;

FIGS. 10, 11 and 12 are sectional views of various magazine arrangements for delivering pigs to a launcher;

FIG. 13 is a sectional view of a magazine for ice pigs;

FIG. 14 is a sectional view of a device for making ice pigs, which can also be used as a magazine for such pigs.

DESCRIPTION OF A PREFERRED EMBODIMENT

Figures 2, 3:
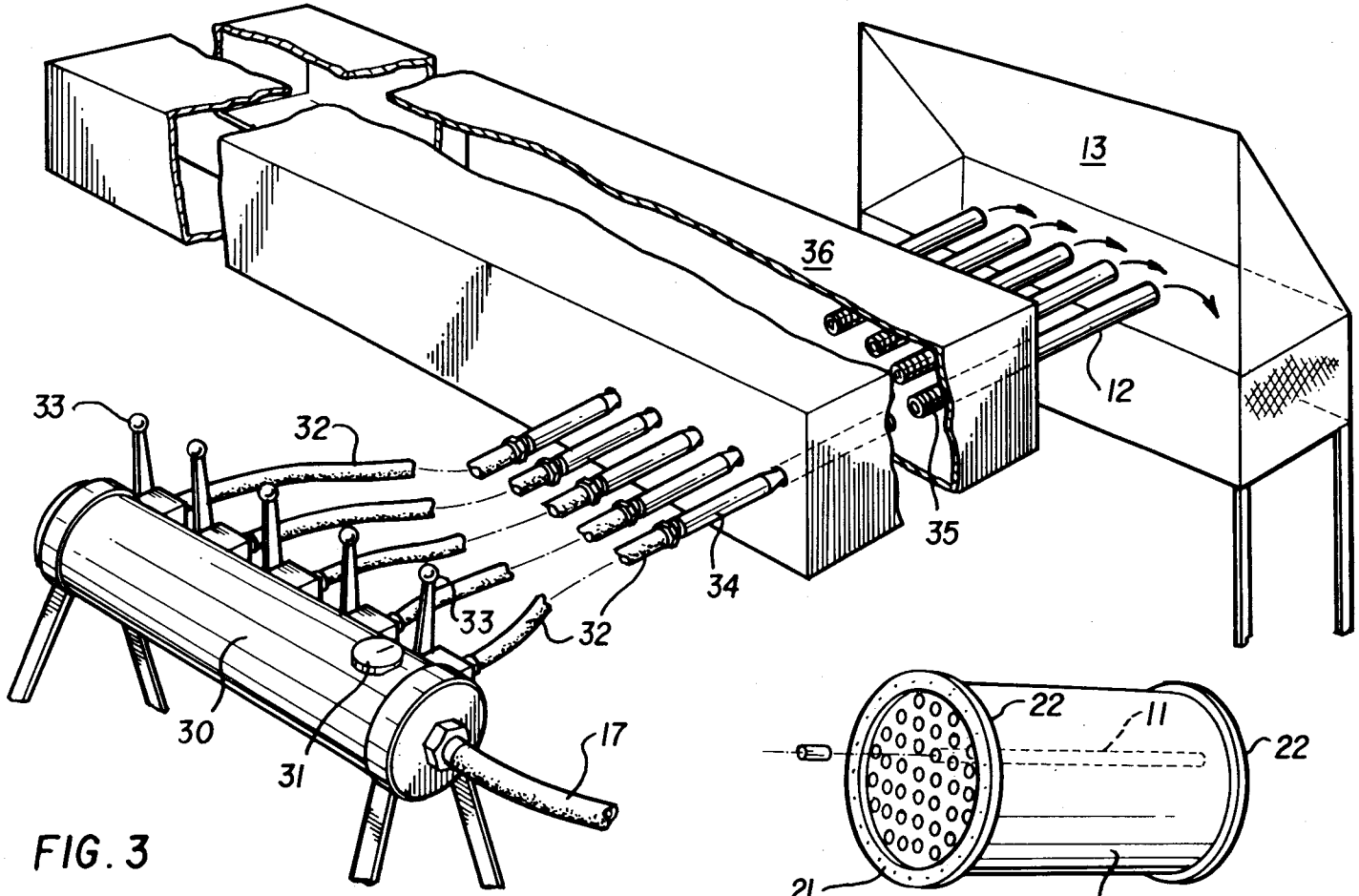
FIG. 2 is a perspective view from one end of a heat exchanger tube bundle, which can be cleaned using the embodiment shown in FIG. 1.
FIG. 3 is another perspective view from one end illustrating an application of the invention to a fin-fan bank.

In FIG. 1, numeral 10 indicates a launcher adjacent one end of a heat exchanger tube 11, connected to a catcher 12 leading to a cage 13. Launcher 10 is provided at one end with a thread 15 and, at the other end (shown as abutting against the end of heat exchanger tube remote from the catcher), a frusto-conical launcher tip 14. Launcher 10 engages support 16 by means of thread 15. Flexible connector 17 connects the apparatus to a source of high pressure liquid.

In FIGS. 1*a*, 1*b* and 1*c*, launcher tips 14*a*, 14*b*, and 14*c* (not shown in proportion) are shown. 14*a* can be used for a relatively small diameter tube 11, 14*b* for an average diameter tube and 14*c* for a larger diameter tube.

In FIG. 1*d*, flexible connector 17 connects to a foot-operated valve 18*a* leading to a high pressure pump 19. In FIG. 1*e*, an alternative type of valve means 18*b* is shown. This valve means is air-operated and allows very rapid opening and closing of the line connecting the high pressure pump 19 to launcher 10. One flexible connector 17 is shown but this alternative allows connection of more than connector 17 to more than one launcher 10.

A bundle of tubes 11 are shown comprising tube bundle 20; see FIG. 2. The ends of the tubes 11 can be seen at end face 21 of tube bundle 20. Flanges 22 are provided at each end of tube bundle 20. A cylindrical pig 23 of "Delrin" is shown in line with the end of one tube 11.

In FIG. 3, flexible connector 19 connects a high pressure pump (not shown) to a manifold 30, having a pressure indicator 31. A series of outlets 32 is shown connected by way of valves 33 to manifold 31. Outlets 32 are connected by way of spacer 34 to launchers (not shown). These launchers abut against the ends of fin-fan tubes 35 forming part of a bank 36. Catchers 32 lead to a cage 13, as in FIG. 1.

Figure 4:
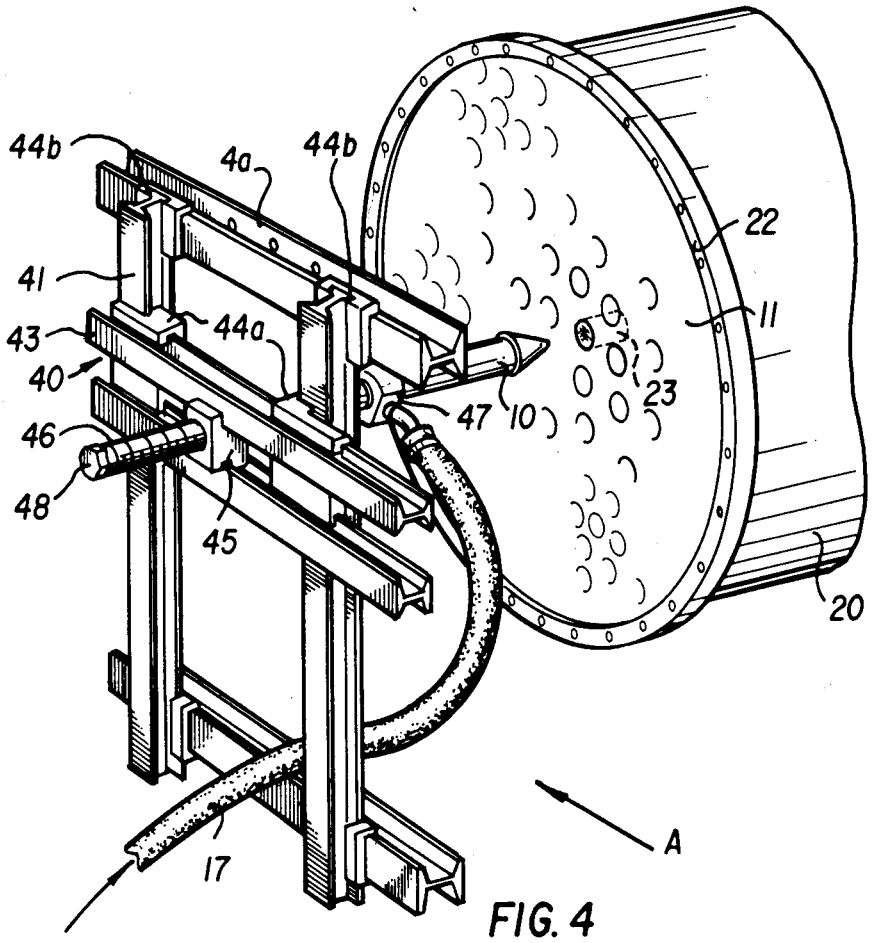
FIG. 4 is another perspective view from one end illustrating the use of an X-Y frame according to the invention.

In FIG. 4, an X-Y frame 40 is shown comprising vertical I-beam components 41 and horizontal I-beam components 42. Movable support means 43 is shown bridging vertical I-beam components 41. Said components 41 and 42 and support means 43 are connected by sliding brackets 44*a* and 44*b*. A thrust block 45 is supported by support means 43. A heavy duty, screw-threaded adjustment means 46 is shown leading to a pressure inlet coupling 47 connecting a launcher 14 to a side-entering flexible connector 17 leading to a valve means (not shown) and a high pressure pump (not shown). Adjustment means 46 may be adjusted by means of a hexagonal nut 48 whereby launcher 10 may be moved axially with respect to the end of a tube 11 in a bundle 20. Holes 49 are provided in horizontal I-beam component 42 whereby the X-Y frame may be bolted to the tube bundle 20 via corresponding holes in flange 22.

Figure 5:
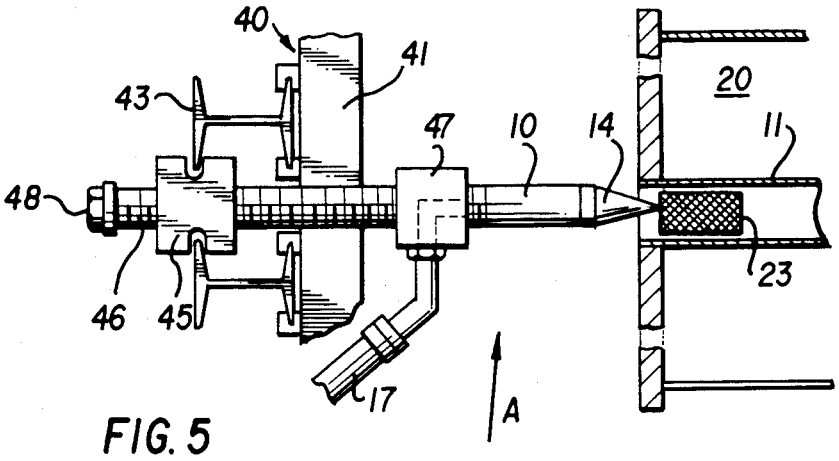
FIG. 5 is a part sectional/part diagrammatic view of the X-Y axis frame embodiment of FIG. 6, taken in direction A shown in FIG. 5.

In FIG. 5, launcher 10 is shown in the launching position for pig 23. High pressure liquid is applied to the pig via inlet coupling 47 and launcher 10.

Figure 6:
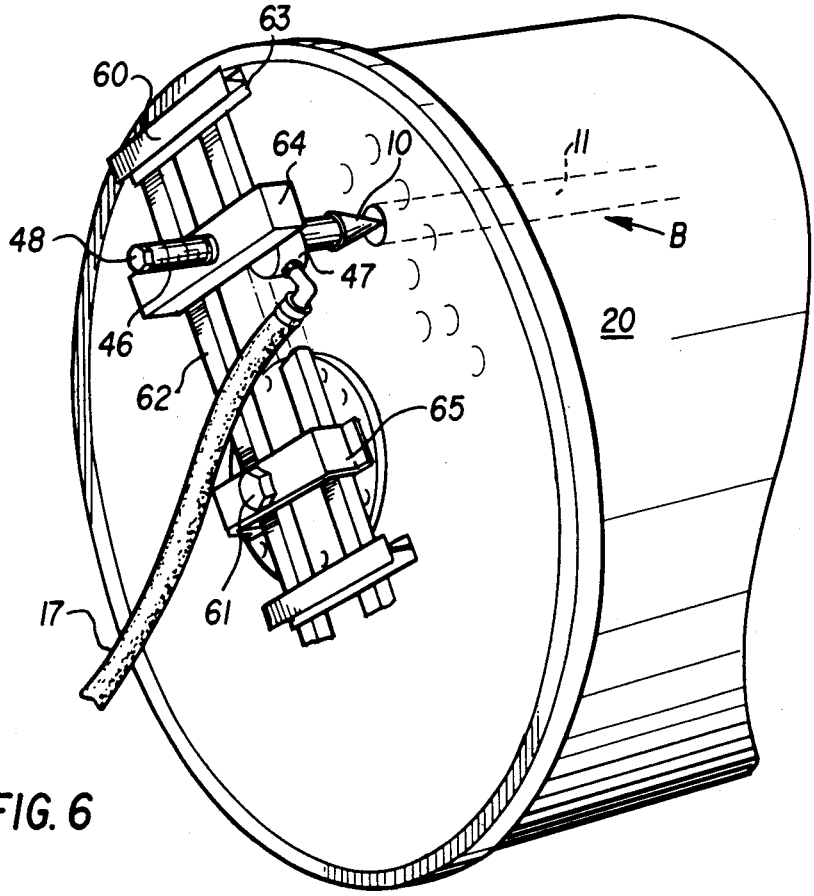
FIG. 6 is a perspective view illustrating the use of a rotary axis adaptor.

In FIG. 6, a rotary axis adaptor 60 is shown as pivoting around a rod (not shown) which penetrates through tube bundle 20. Adaptor 60 comprises two radial I-beam components 62, two I-beam cross-pieces 63, an adjustable thrust block 64 and an adjustable clamp 65, whereby adjustment means 46, and launcher 10, may be moved radially with respect to the axis of the tube bundle and located adjacent a selected tube 11. Numeral 61 indicates a nut whereby adjustable clamp 65 may be tightened upon the aforementioned rod, the adaptor bearing against round spacer plate 66.

Figure 7:
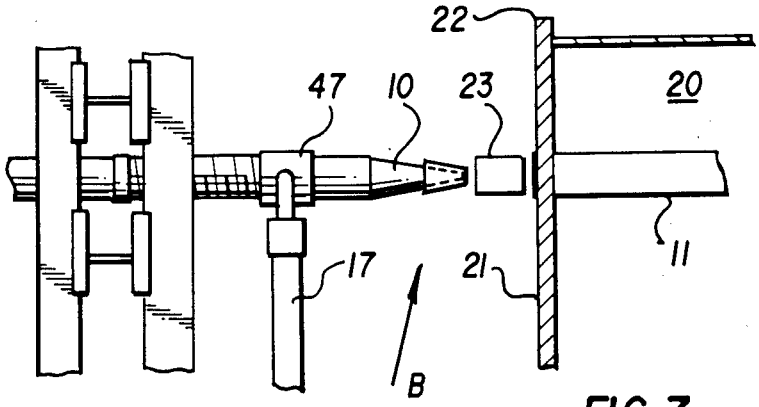
FIG. 7 is a part sectional/part diagrammatic view of the rotary axis adaptor embodiment of FIG. 6, taken in direction B in FIG. 6.

In FIG. 7, launcher 10 is shown adjacent a pig 23 and tube 11. This view is similar to that shown in FIG. 5.

Taking as an example a tube bundle 20 and the embodiment of FIG. 3, a cylindrical pig of "Delrin" 23 is located at one end of each tube 11 to be cleaned, that is, adjacent end face 21. The pigs may be launched one at a time sequentially or two or more at a time. The pump is started and delivers high pressure liquid such as water to manifold 30. Valves 33 may be opened one at a time or more than one at a time. (The valves are suitably rapid acting, ball valves.) The pig or pigs travel through tube(s) 11, deaccelerate in catcher(s) 12 and fall into cage 13. Launchers 10 are maintained in position with respect to the fin-fan tube stack by any suitable means, for example, by means of a deadweight, by clamping, bolting or using the X-Y frame 40 or rotary axis adaptor 60 just described.

Referring to FIGS. 4 and 5, the use of a flexible connector 17 and the X-Y frame 40 enables launcher 10 to be moved from tube to tube, as desired. The X-Y frame is held in a fixed positio with respect to tube bundle 20 by bolting to flange 22, thus withstanding the back pressure when the valve (not shown) is actuated.

The X-Y frame of FIGS. 4 and 5 and the rotary axis adaptor of FIGS. 6 and 7 provide primary locations and support, whereas the apparatus of FIGS. 8 and 9 (to be described below) can be used to provide secondary location and support.

Figure 8:
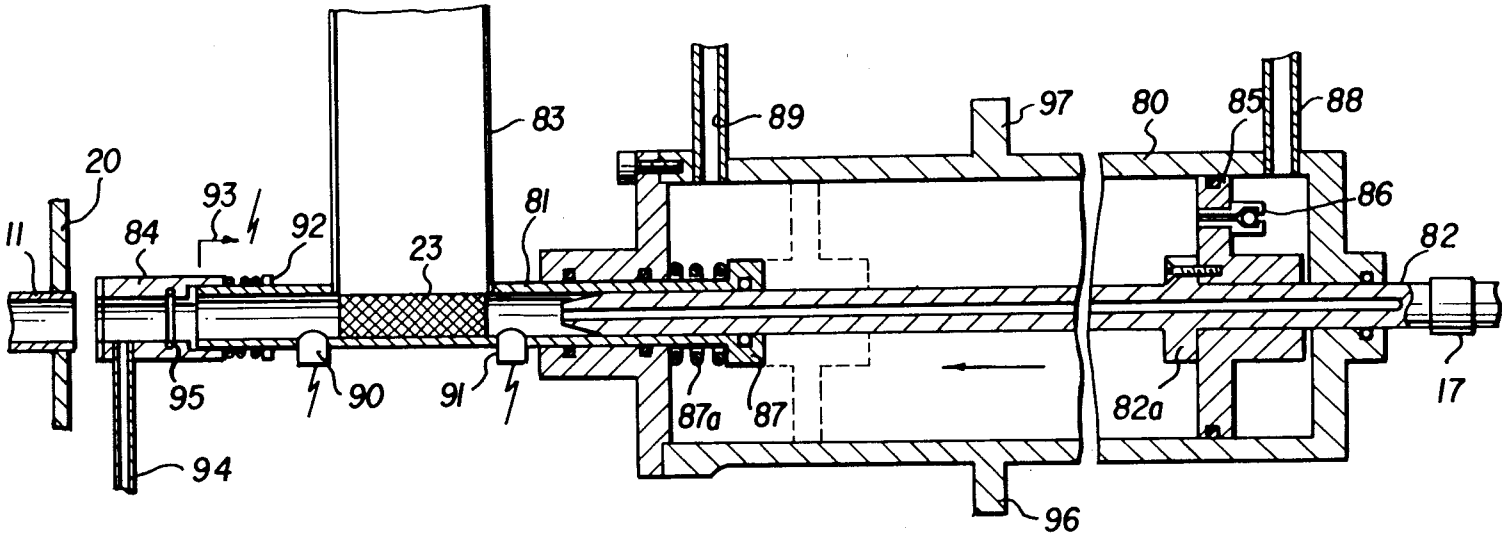
FIG. 8 is a sectional view of an apparatus which provides secondary positioning for a launcher according to the invention.

Referring to FIG. 8, hydraulic cylinder 80 is provided with a guide tube 81, into which may be inserted launcher 82 to contact pig 23 to propel the pig through tube 11 in bundle 20. Guide tube 81 is provided with a magazine 83 for a plurality of pigs 23. At that end of guide tube 81 remote from hydraulic cylinder 80 is positioned a partial sealing element 84, adapted to connect guide tube 81 with the end of tube 11.

Hydraulic cylinder 80 is provided with a piston 85 fitted with one-way check valve 86 incorporating a calibrated leak. Launcher 82 penetrates piston 85 and is attached thereto by way of collar 82*a*. Launcher 82 also penetrates guide tube 81 initially through end 87 formed as a shoulder on guide tube 81. Spring means 87*a* is provided between shoulder 87 and the adjacent end of hydraulic cylinder 80. Hydraulic cylinder 80 is also provided with inlet/outlet means 88 and 89 for hydraulic fluid. Launcher 82 is connected, as described previously, to flexible connector 17.

Detectors 90 and 91 are provided in the wall of guide tube 81 just forward and rearward respectively of the pig 23 in its initial, loaded position, as shown in FIG. 8. Sealing element 84 may move to a limited extent with respect to that end of guide tube 81 with which it is engaged. This movement is restrained by spring element 92 and is detected by detector 93, which serves as a safety interlock to prevent early ejection of pig 23.

Sealing element 84 is provided with a leak 94. An O-ring seal 95 is provided within sealing element 84, whereby high pressure liquid is prevented from leaking rearwardly when launcher 82 is advanced to its operative position.

Hydraulic cylinder 80 is provided with external lugs 96 and 97, whereby the cylinder may be attached to a suitable support/locating means, such as the X-Y frame of FIGS. 4 and 5 or the rotary axis adaptor of FIGS. 6 and 7.

In operation, piston 86 is displaced by a flow of pressurised water or hydraulic oil entering hydraulic cylinder 80 through inlet 88. Said piston is retracted by means of a flow of pressurised water or hydraulic oil through inlet 89. As launcher 82 approaches its fully operative position, shoulder 87 abuts against collar 82*a*, further movement of the launcher 82 pushes guide tube 81 forward against the pressure of spring 87*a*, bringing the muzzle of sealing element 84 firmly into contact with the tube 11.

Detectors 90 and 91 are provided to detect the presence of pig 23. Sealing element 84 is slidably mounted against the pressure of spring element 92. Detector 93 detects the pressure of the sealing element on the end of tube 11.

Check valve 86 incorporating a calibrated leak serves to reduce the hydraulic pressure in cylinder 80 during the retract stroke, so as to not inhibit the retraction of guide tube 81 by the pressure of spring 88.

The unit is located with guide tube 81 collinear with tube 11, sealing element 84 being positioned a short distance from tube 11. An operating cycle, which is preferably by a suitable microprocessor device (not shown) controlled, is then commenced. Pressurised water or hydraulic fluid enters cylinder 80 through inlet 88, displacing piston 85 and launcher 82 towards the operative position. Launcher 82 picks up pig 23, which has descended through magazine 83, carrying it forward through guide tube 81 into tube 11. Simultaneous movement of launcher 82 and pig 23 is detected by detectors 90 and 91, the cycle being terminated by an interlock system in the absence of a pig. Continued forward movement of launcher 82 brings collar 82a into abutment with shoulder 87, forcing guide tube 81 forward against the pressure of spring 88.

Following a signal from detector 93, a valve (not shown) is opened releasing for a predetermined period a flow of suitably pressurised liquid through the launcher 82 to the rear face of pig 23, which is driven through tube 11. When the flow of liquid has ceased, a flow of pressurised water or hydraulic fluid is admitted to cylinder 80 through inlet 89, that on the other side of piston 85 being exhausted through inlet 88. Piston 85 and attached launcher 82 are displaced towards the inoperative position. Guide tube 81 is retracted by pressure of spring 88 and as the launcher 82 passes the magazine 83 a new pig (not shown) descends into guide tube 81. When complete retraction is verified by extension of sealing element 84 and detector 93, the complete unit is traversed (by an apparatus such as that described with reference to either FIG. 4. or FIG. 15) until the barrel is collinear with the next tube to be cleaned. The cycle is then repeated.

Figure 9:
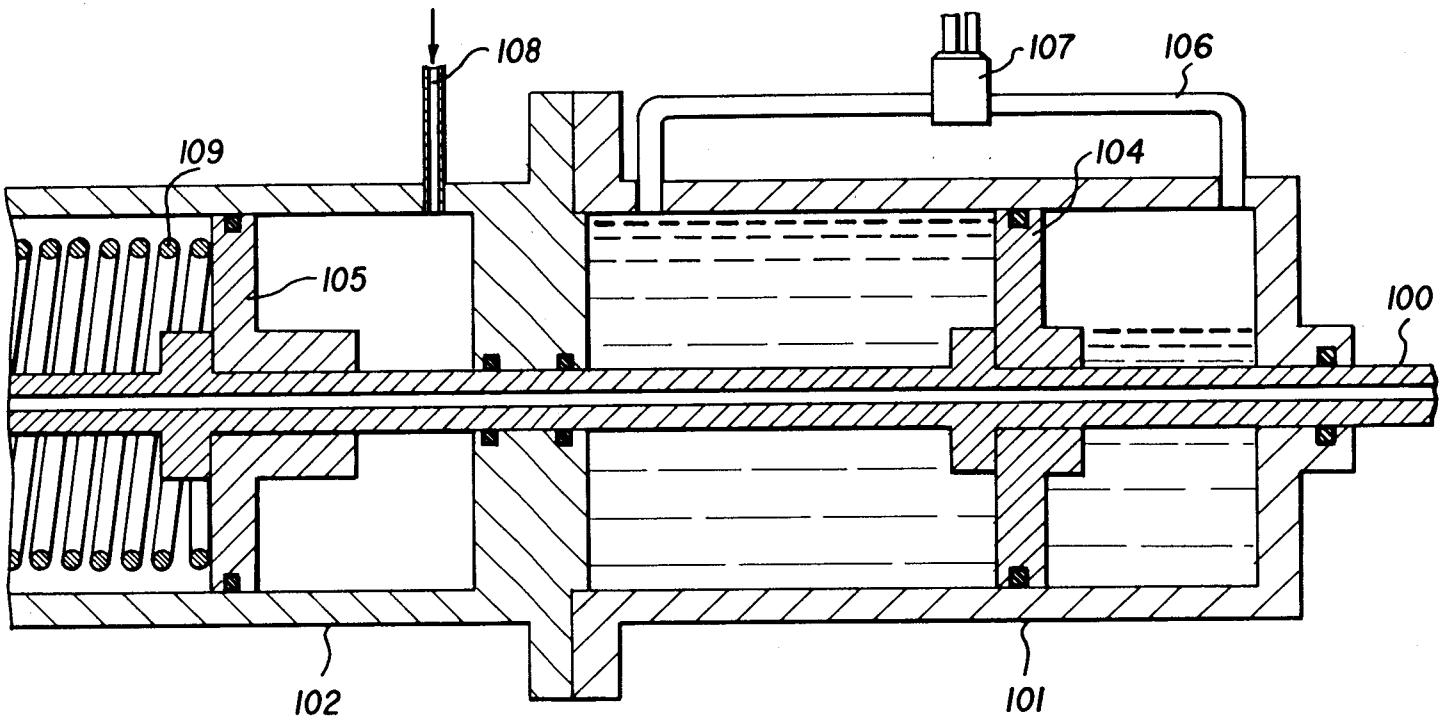
FIG. 9 is a sectional view of a modified version of the apparatus shown in FIG. 8.

Referring now to FIG. 9, launcher 100 is shown as penetrating two cylinders 101 and 102 mounted in series. Cylinder 101 is hydraulically operated, whereas cylinder 102 is pneumatically operated. Launcher 100 is attached to and penetrates a piston 104 in hydraulic cylinder 101 and also is attached to an penetrates a piston 105 in pneumatic cylinder 102; compare the embodiment of FIG. 8. The forward and rearward chambers of hydraulic cylinder 101 are connected by duct 106, which is opened or closed by valve means 107. One inlet/outlet 108 is shown connecting with the rearward shoulder of pneumatic cylinder 102. A mechanical spring means 109 is shown in the forward chamber of pneumatic cylinder 102.

In operation, compressed air is admitted to cylinder 102 through inlet 108, displacing piston 105 and attached launcher 100 towards the operative position against the pressure of spring 109. Piston 104 attached to launcher 100 moves in tandem with piston 105. Duct 106 allows a free flow of hydraulic fluid from one chamber to the other during movement of launcher 100. Following complete deployment of launcher 100, it is locked in the operative position by closure of valve 107 as part of an automatic cycle. Following termination of the flow of liquid under pressure through launcher 100, valve 107 is opened, air is exhausted through inlet/outlet 108 and launcher 100 is allowed to fully retract under pressure of spring 108. The cycle may then be repeated Referring to FIG. 10, numeral 110 indicates a magazine is cross-section, as shown in side-view in FIG. 8. In FIG. 11, an alternative hopper-type magazine 111 is shown, and, in FIG. 12, yet another alternative, inclined magazine 112 is shown holding a series of pigs 23.

Referring now to FIG. 13, this shows a partial cross-sectional view of a magazine 113 for ice pigs. These pigs are frozen in any suitable mould, for example, that shown in FIG. 14. Ice pigs 114 are wrapped serially using a strip 115 of suitable plastics material, for example, of Teflon. Strip 115 may be manipulated to adjust the position of pigs 114, since it is allowed to project through slot 116 in magazine 113.

Strip 115 prevents pigs 114 from freezing together. Slot 116 corresponds with an equivalent aperture in the lower region of guide tube 81; see FIG. 8. Magazine 113 may be insulated or provided with refrigeration means to prevent the pigs from melting before they are used.

The belt type mould shown in FIG. 14 is of some suitable, waterproof material. Caps 118 may be formed into a strip of the same length as body portions 117. To make the pigs, caps 118 are clipped onto body portions 117. The mould is stood with open ends 119 upward, filled with water and placed in a refrigerator. When the water is frozen the caps 118 are removed exposing the noses 120 of ice pigs 114. These ice pigs 114 can be used in the magazine of FIG. 13.

Alternatively the mould of FIG. 14 may be inserted into the magazine 83 of FIG. 8, the nose 120 of the first ice pig 114 resting on the lower inner surface of guide tube 81 on the edge of a slot (not shown) in the lower side of the guide tube 81, which slot is of such dimensions as to allow the passage through it of the empty mould. As launcher 82 travels forward, it pushes the first ice pig from the strip mould forward into the tube 11 to be cleaned. Upon retraction of launcher 82, body portion 117 of the mould descends through the slot in the lower side of guide tube 81 until the nose 120 of the next ice pig is resting on the lower side of guide tube 81. The cycle is then repeated.

Figure 15:
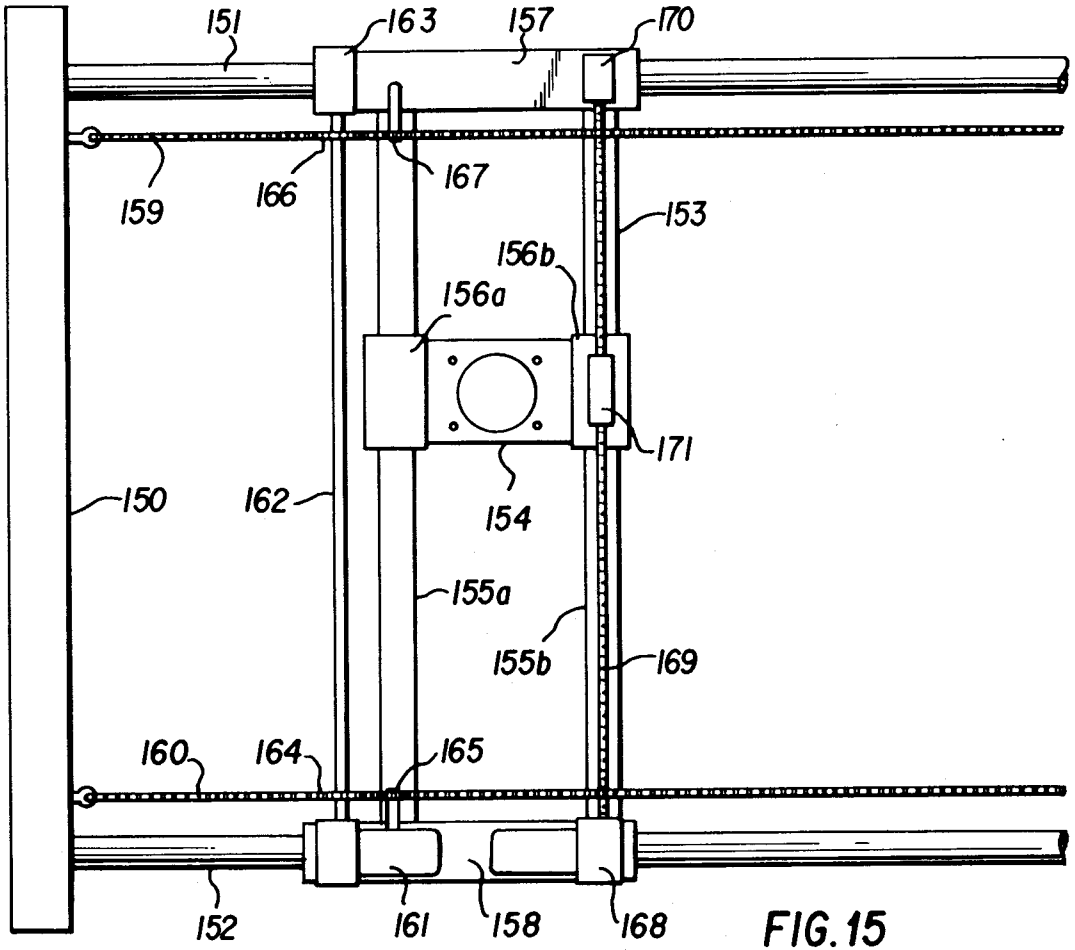
FIG. 15 is a modified X-Y axis frame for providing primary positioning for a launcher assembly.

Referring to FIG. 15, a modified version of an X-Y frame is shown. This modification may be mounted on, for example, a tube bundle by any suitable means in such a manner that a launcher may be located adjacent the end of any tube to be cleaned.

In FIG. 15, numeral 150 incidates one vertical frame element of the modified X-Y frame and numerals 151 and 152 the upper and lower horizontal frame elements respectively. A travelling assembly, indicated generally by numeral 153, comprises a mounting plate 154 for a launcher and two vertical guides 155a and 155b respectively. Two sliding elements 156a and 156b are shown, slidably connected to vertical guides 155a and 155b respectively. Assembly 153 is connected to upper and lower horizontal frame elements 151 and 152 by means of carriages 57 and 158 respectively. Upper and lower horizontal chain means 159 and 160 are shown attached at each end to vertical frame elements (one only is shown). Chain means 159 and 160 run parallel to upper and lower horizontal frame elements respectively.

Mounted on lower carriage 158 are electric motors 161 and 168 provided with suitable step-down gears. Electric motor 161 drives shaft 162, which is journalled in bearing 163 mounted in upper carriage 157. Shaft 162 is provided with drive sprocket wheels 164 and 166, which engages with lower chain means 160 and upper chain means 159 respectively. Upper chain means 159 travels under drive sprocket wheel 166 and then over idler sprocket wheel 167. Lower chain means 160 travels under drive sprocket wheel 164 and then over idler sprocket wheel 165.

Electric motor 168 drives screw means 169, the other end of which is journalled in bearing 170 mounted on upper carriage 157. Screw means 169 turns within nut 171 fixed to sliding element 156b.

In operation, X-axis movement is achieved by intermittent operation of drive motor 161, causing rotation of shaft 162, resulting in sprockets 164 and 166 generating tractive effort in chain means 160 and 159 respectively. Carriages 157 and 158 are caused to slide along horizontal frame elements 151 and 152. Y-axis movement is achieved by intermittent operation of drive motor 168 causing rotation of screw means 169. Thrust is generated at nut 191, causing sliding elements 156a and 156b to slide along vertical guides 155a and 155b respectively accompanied by mounting plate 154.

The embodiment just described is one preferred as are the embodiments of FIGS. 4 to 7 inclusive. However, it is recognised that X- and Y-axis movement of the launcher assembly may be achieved by the use of rams actuated by pressurised water, hydraulic fluid or air; lead screws operated by motors driven by electricity, air, water or hydraulic fluid pressure; or by linear actuators operated by electricity, air, water or hydraulic fluid pressure; see also FIGS. 8 and 9.

Where a heat exchanger, condenser or the like to be cleaned is made with a permanently fixed header tank, it is necessary to provide means to move the launcher bodily inwards to penetrate the header tank and contact the end of a tube to be cleaned. It is further necessary to disengage the launcher from the header tank and permit X- and Y-axis movement. In this case, the launcher assembly, for example, that shown in FIG. 15, is provided with one or more secondary rams, linear actuators or apparatus as described with reference to FIGS. 8 and 9 mounted upon the launcher assembly. Such rams or linear actuators may be operated by electricity, water, pneumatic or hydraulic oil pressure.

It is pointed out that various minor alterations may be made to the abovementioned apparatus without altering the essential invention. For example, thread 15 (see FIG. 1) may be replaced by a bayonet coupling and catcher 12 may be curved not straight. Furthermore, the X-Y frame may be modified to provide movement along the Z axis also, see FIG. 4, and movement may be controlled hydraulically, by means of air pressure or an electric linear actuator.

Referring to FIG. 4 in particular thrust block 45 and corresponding screw thread adjustment means 46 may be replaced by a hydraulic cylinder adjustment means.

We claim:

1. A method of cleaning tubes by pigging which comprises:

(1) applying a highly pressurized liquid to one face of a suitably dimensioned, relatively incompressible, solid pig located adjacent one end of said tube locus so as to provide a pressure build-up at said pig which is sufficiently rapid to produce one or more water hammer shock waves which pass down the length of said tube, said pig being dimensioned to conform with the average lumen defined by the thickness of deposits on the tube; and (2) maintaining pressure on said pig for a sufficient time to propel said pig at high velocity through said tube locus to be cleaned, whereby at least portions of said deposits are loosened within said tube by said one or more shock waves and are expelled from said tube by said propelled pig, and (3) if necessary, successively repeating steps (1) and (2) as successive layers of deposits are removed, with pigs of successively larger diameter.

2. A method as claimed in claim 1, wherein said liquid is water.

3. A method as claimed in claim 1, wherein said pig is of ice.

4. An apparatus for cleaning tubes comprising a high pressure pump;

means for creating water hammer shock waves comprising quick-operating valve means connected to said pump and to one or more pressure outlets;

one or more launchers, said pressure outlets leading to said one or more launchers and each of said one or more launchers comprising a high pressure connecting means and a launcher tip, said launcher tip engaging the end of a tube to be cleaned and being of such internal diameter that pressure drop within said launcher tip is prevented or minimized whereby liquid may be brought into contact with a pig located in said tube to be cleaned but minor leakage is permitted between said launcher tip and said tube end, and a magazine for pigs associated with each said one or more launchers whereby such pigs may be fed sequentially to each said launcher.

5. Apparatus as claimed in claim 4 and further including a partial sealing element for providing a partial seal between said launcher tip and said end of a tube to be cleaned.

6. Apparatus as claimed in claim 4 and further including a safety interlock means whereby a pig may not be launched when said safety interlock means is operative.

7. Apparatus as claimed in claim 4 and further including an X-Y frame for maintaining said one or more launchers in position with respect to the end or ends of a selected tube or tubes to be cleaned whereby said tube or tubes may be cleaned sequentially or simultaneously.

8. Apparatus as claimed in claim 7 wherein said X-Y frame comprises vertical support beams and horizontal support beams in combination with movable support means for one or more launchers, which movable support means maintains said launcher or launchers in position and resists back pressure when said one or more launchers are used.

9. Apparatus as claimed in claim 4 and further including a rotary axis adaptor for maintaining one or more launchers in position with respect to the end or ends of a selected tube or tubes to be cleaned whereby said tube or tubes may be cleaned sequentially or simultaneously.

10. Apparatus as claimed in claim 9 wherein said rotary axis adaptor comprises one or more radial support beams in combination with an axial support means and radially-movable support means, which support means attaches to a bundle of tubes to be cleaned and which radially-movable support means maintains said launcher or launchers in position and resists back pressure when said one or more launchers are used.

11. Apparatus as claimed in claim 8 or 10 and further including secondary adjustment means for advancing, maintaining or withdrawing said one or more launchers over a short distance range with respect to a tube locus; and position detector means whereby said advance, maintenance or withdrawal takes place in response to signals from said position detector means.

12. Apparatus as claimed in claim 4 wherein said magazine includes a plurality of ice pigs, said ice pigs being wrapped serially with a strip of plastic material for preventing said ice pigs from freezing together, the position of said strip being adjustable so as to adjust the position of said ice pigs in said magazine, said magazine being thermally insulated to prevent melting of said ice pigs.

13. Apparatus as claimed in claim 4 wherein said magazine includes a mould comprising a plurality of cylindrical body portions joined longitudinally to form said mould, each body portion having an open end and an opposite end closed by a removable cap, whereby water poured into said mould is frozen to form a plurality of said ice pigs in said mould, said mould being inserted in said magazine.

* * * * *